US008915581B2

(12) United States Patent
Jia et al.

(10) Patent No.: US 8,915,581 B2
(45) Date of Patent: Dec. 23, 2014

(54) INK CARTRIDGE, INK CARTRIDGE ASSEMBLY AND INK CARTRIDGE DETERMINATION SYSTEM

(75) Inventors: Zhizheng Jia, Guangdong (CN); Shengyu Wei, Guangdong (CN)

(73) Assignee: Zhuhai Ninestar Management Co., Ltd., Zhuhai, Guangdong (CN)

( * ) Notice: Subject to any disclaimer, the term of this patent is extended or adjusted under 35 U.S.C. 154(b) by 0 days.

(21) Appl. No.: 13/582,727

(22) PCT Filed: Nov. 22, 2010

(86) PCT No.: PCT/CN2010/078945

§ 371 (c)(1),
(2), (4) Date: Sep. 4, 2012

(87) PCT Pub. No.: WO2011/137641

PCT Pub. Date: Nov. 10, 2011

(65) Prior Publication Data

US 2013/0044164 A1 Feb. 21, 2013

(30) Foreign Application Priority Data

May 1, 2010 (CN) ..... 2010 1 0169547

(51) Int. Cl.
*B41J 2/175* (2006.01)

(52) U.S. Cl.
CPC .... *B41J 2/17546* (2013.01); *B41J 2002/17573* (2013.01); *B41J 2/17566* (2013.01)
USPC ..... 347/86

(58) Field of Classification Search
CPC ..... B41J 2/17513
USPC ..... 347/86
See application file for complete search history.

(56) References Cited

U.S. PATENT DOCUMENTS

| | | | | |
|---|---|---|---|---|
| 7,222,950 | B2 * | 5/2007 | Hattori et al. | 347/86 |
| 7,290,870 | B2 * | 11/2007 | Hattori et al. | 347/86 |
| 7,325,908 | B2 * | 2/2008 | Katoh et al. | 347/85 |
| 7,360,880 | B2 * | 4/2008 | Silverbrook | 347/86 |
| 7,553,007 | B2 * | 6/2009 | Hattori et al. | 347/86 |
| 7,661,813 | B2 * | 2/2010 | Silverbrook et al. | 347/109 |
| 2007/0070149 | A1 * | 3/2007 | Hattori et al. | 347/86 |
| 2007/0291088 | A1 * | 12/2007 | Katayama et al. | 347/86 |
| 2009/0135236 | A1 * | 5/2009 | Shimoda | 347/86 |
| 2010/0245459 | A1 * | 9/2010 | Kanbe et al. | 347/19 |
| 2010/0289847 | A1 * | 11/2010 | Ishizawa et al. | 347/19 |
| 2011/0001781 | A1 * | 1/2011 | Ishibe | 347/86 |
| 2011/0310189 | A1 * | 12/2011 | Kanbe et al. | 347/86 |
| 2013/0033552 | A1 * | 2/2013 | Chen et al. | 347/86 |

* cited by examiner

*Primary Examiner* — Matthew Luu
*Assistant Examiner* — Patrick King
(74) *Attorney, Agent, or Firm* — Jackson IPG PLLC

(57) ABSTRACT

The invention relates to an ink cartridge, an ink cartridge set and an ink cartridge determination system. The invention comprises a first signal blocking section and a second signal blocking section, wherein the second signal blocking section is a movable component and is in an initial ink cartridge installation detection position before detection, and the initial ink cartridge installation detection position determines whether or not the second signal blocking section prevents a second signal from passing through the second signal blocking section or changes the path of the second signal. That is to say, different ink cartridges can be distinguished by different initial ink cartridge installation detection positions of the movable second signal blocking section.

7 Claims, 8 Drawing Sheets

INK CARTRIDGE, INK CARTRIDGE ASSEMBLY AND INK CARTRIDGE DETERMINATION SYSTEM

FIELD OF THE INVENTION

The invention relates to an ink cartridge, an ink cartridge set and an ink cartridge determination system.

BACKGROUND OF THE INVENTION

An ink cartridge which is engaged with an inkjet printer mainly comprises a storage cavity for storing ink, an ink outlet for supplying ink to a printhead of the printer, and a detection component for detecting the ink cartridge installation and the residual ink volume. For the sake of guaranteeing the normal operation of the ink cartridge after the ink cartridge is installed into the printer, the ink cartridge must comprise two detection mechanisms. When the ink cartridge is installed into the printer, firstly, one detection mechanism disables light transmitted by a transmitting part of a second sensor on the printer to return to a receiving part of the second sensor; secondly, with the ink cartridge installation, the light transmitted by the transmitting part of the second sensor could return to the receiving part of the second sensor; thirdly, the other detection mechanism disables light transmitted by a transmitting part of a first sensor on the printer to return to a receiving part of the first sensor; and finally, the light transmitted by corresponding transmitting parts of the first sensor and the second sensor could not return to corresponding receiving parts of the first sensor and the second sensor, and the ink cartridge installation detection is completed herein, then the printer prompts to carry out the next operation. The technical measures for detecting the ink cartridge installation and the residual ink volume are as follows: the detection mechanisms of the embodiment mainly realize the detection by blocking light transmitted by sensors, and the operating principle of the detection mechanisms is as follows: when the ink cartridge is installed into the printer, firstly, light transmitted by the second sensor in the printer is blocked by a light-tight second signal blocking section; secondly, the light transmitted by the second sensor is not blocked by the light-tight second signal blocking section while light transmitted by the first sensor is blocked by a first signal blocking section; and finally, the light transmitted by the second sensor is blocked by a light-tight third detection component and the light transmitted by the first sensor is blocked by the first signal blocking section, and herein the printer prompts the existence of the ink cartridge and the admission of the next operation. The third detection component consists of a light-admitting part and a light-tight movable member; the position of the movable member is varied with the ink level in the ink cartridge; and the ink level in the ink cartridge can be detected by the fact that whether the light transmitted by the second sensor is blocked by the third detection component or not.

For example, the patent CN200710159947.7 discloses a known recording device. Moreover, the device can determine the type of another known ink cartridge according to the varied light intensity. More specifically, when the ink cartridge is installed into an ink cartridge installation section, the recording device checks the existence of a signal blocking section of the ink cartridge and determines the type of the ink cartridge according to the fact that whether the ink cartridge is provided with a signal blocking section or not. The recording device of the ink cartridge with the structure is allowed to accurately determine related information of the ink cartridge irrespective of the speed of installation of the ink cartridge into a printer by a user. Moreover, whether the user begins to insert the ink cartridge into the printer is not considered, and partial ink cartridge is dismounted before the ink cartridge is finally and completely inserted into the printer.

Two signal blocking sections of the ink cartridge with the structure can selectively prevent signals from passing through the signal blocking sections or change the path of the signals. Moreover, the second signal blocking section has thickness. When the first signal blocking section begins to block a first signal or change the path of the first signal, the thickness determines whether or not the second signal blocking section blocks a second signal or changes the path of the second signal.

Therefore, as the thickness of second signal blocking sections of different types of ink cartridges in an ink cartridge set is different, different types of ink cartridges must be installed with second signal blocking sections with corresponding thickness to form complete ink cartridges during the production and installation. Once the ink cartridge installation error of an ink cartridge occurs, the printer will detect the information not matched with the actual information of the ink cartridge.

SUMMARY OF THE INVENTION

The invention provides an ink cartridge, an ink cartridge set and an ink cartridge determination system to solve the technical problem, in the traditional ink cartridge, ink cartridge set and ink cartridge determination system, that different ink cartridges are distinguished by different thicknesses of second signal blocking sections, which causes the ink cartridge installation error easily and enables a printer to detect information not matched with the actual information of an ink cartridge.

In order to solve the technical problem, the invention adopts the technical proposal that:

The invention relates to an ink cartridge, which comprises:

a first signal blocking section selectively preventing a first signal from passing through the first signal blocking section or changing the path of the first signal; and a second signal blocking section selectively preventing a second signal from passing through the second signal blocking section or changing the path of the second signal, wherein the second signal blocking section is a movable component and is in an initial ink cartridge installation detection position before detection, and the initial ink cartridge installation detection position determines whether or not the second signal blocking section prevents the second signal from passing through the second signal blocking section or changes the path of the second signal.

The initial ink cartridge installation detection position of the second signal blocking section is at least matched with at least one related characteristic of the ink cartridge.

The ink cartridge also comprises an ink storage cavity for storing ink.

The second signal blocking section can move to an ink level detection position corresponding to a second sensor for a printer; and when the second signal blocking section moves to the ink level detection position, the second signal blocking section selectively prevents the second signal from passing through the second signal blocking section or changes the path of the second signal again.

The ink storage cavity is in the form of an ink bag, and the volume of a cavity body is varied with the ink level.

The ink cartridge also comprises a linkage; the second signal blocking section can move to an engagement position; and when the second signal blocking section moves to the engagement position, the linkage moves according to the varied ink level in the ink storage cavity so as to selectively abut against the second signal blocking section.

The movement refers to horizontal translation or swinging movement around a shaft.

The invention relates to an ink cartridge set, which comprises a first ink cartridge and a second ink cartridge, wherein the first ink cartridge and the second ink cartridge are said ink cartridges;

a second signal blocking section of the first ink cartridge is provided with an initial ink cartridge installation detection position which is used for determining that the second signal blocking section prevents a second signal from passing through the second signal blocking section or changes the path of the second signal when a first signal blocking section begins to prevent a first signal from passing through the first signal blocking section or change the path of the first signal; and a second signal blocking section of the second ink cartridge is provided with an initial ink cartridge installation detection position which is used for determining that the second signal blocking section does not prevent a second signal from passing through the second signal blocking section or change the path of the second signal when a first signal blocking section begins to prevent a first signal from passing through the first signal blocking section or change the path of the first signal.

The invention relates to an ink cartridge determination system, which comprises:

said ink cartridge or said ink cartridge set;

a recording device, wherein the recording device comprises an ink cartridge installation section on which the ink cartridge is installed;

a first sensor, wherein the first sensor is arranged inside the ink cartridge installation section and comprises a first signal transmitting element for transmitting a first signal and a first receiving element for receiving the first signal; the first signal blocking section at least selectively prevents the first signal from passing through the first signal blocking section or changes the path of the first signal when the ink cartridge is installed into the ink cartridge installation section; and the intensity of the first signal received by the first signal receiving element when the first signal blocking section prevents the first signal from passing through the first signal blocking section or changes the path of the first signal is different from that of the first signal received by the first signal receiving element when the first signal blocking section does not prevent the first signal from passing through the first signal blocking section or change the path of the first signal;

a second sensor, wherein the second sensor is arranged inside the ink cartridge installation section and comprises a second signal transmitting element for transmitting a second signal and a second receiving element for receiving the second signal; the second signal blocking section selectively prevents the second signal from passing through the second signal blocking section or changes the path of the second signal when the ink cartridge is installed into the ink cartridge installation section; and the intensity of the second signal received by the second signal receiving element when the second signal blocking section prevents the second signal from passing through the second signal blocking section or changes the path of the second signal is different from that of the second signal received by the second signal receiving element when the second signal blocking section does not prevent the second signal from passing through the second signal blocking section or change the path of the second signal; and a determiner, wherein the determiner determines related information of the ink cartridge according to the intensity of the second signal received by the second signal receiving element when the intensity of the first signal received by the first signal receiving element begins to change when the ink cartridge is installed into the ink cartridge installation section.

The invention relates to an ink cartridge set, which comprises a first ink cartridge and a second ink cartridge, wherein the first ink cartridge and the second ink cartridge are said ink cartridges;

a second signal blocking section of the first ink cartridge is provided with an initial ink cartridge installation detection position which is used for determining that the second signal blocking section prevents a second signal from passing through the second signal blocking section or changes the path of the second signal when a first signal blocking section begins to prevent a first signal from passing through the first signal blocking section or change the path of the first signal; and a second signal blocking section of the second ink cartridge is provided with an initial ink cartridge installation detection position which is used for determining that the second signal blocking section does not prevent a second signal from passing through the second signal blocking section or change the path of the second signal when a first signal blocking section begins to prevent a first signal from passing through the first signal blocking section or change the path of the first signal.

The invention relates to an ink cartridge determination system, which comprises:

said ink cartridge or said ink cartridge set;

a recording device, wherein the recording device comprises an ink cartridge installation section on which the ink cartridge is installed;

a first sensor, wherein the first sensor is arranged inside the ink cartridge installation section and comprises a first signal transmitting element for transmitting a first signal and a first receiving element for receiving the first signal; the first signal blocking section at least selectively prevents the first signal from passing through the first signal blocking section or changes the path of the first signal when the ink cartridge is installed into the ink cartridge installation section; and the intensity of the first signal received by the first signal receiving element when the first signal blocking section prevents the first signal from passing through the first signal blocking section or changes the path of the first signal is different from that of the first signal received by the first signal receiving element when the first signal blocking section does not prevent the first signal from passing through the first signal blocking section or change the path of the first signal;

a second sensor, wherein the second sensor is arranged inside the ink cartridge installation section and comprises a second signal transmitting element for transmitting a second signal and a second receiving element for receiving the second signal; the second signal blocking section selectively prevents the second signal from passing through the second signal blocking section or changes the path of the second signal when the ink cartridge is installed into the ink cartridge installation section; when the ink cartridge is installed into the ink cartridge installation section and the second signal blocking section moves to an ink level detection position, the second signal blocking section selectively prevents the second signal from passing through the second signal blocking section or changes the path of the second signal again; and the intensity of the second signal received by the second signal receiving element when the second signal blocking section prevents the second signal from passing through the second signal blocking section or changes the path of the second signal is different from that of the second signal received by the second signal receiving element when the second signal blocking section does not prevent the second signal from passing through the second signal blocking section or change the path of the second signal; and a determiner, wherein the determiner determines related information of the ink cartridge according to the intensity of the second signal received by the second signal receiving element when the intensity of the first signal received by the first signal receiving element begins to change when the ink cartridge is installed into the ink cartridge installation section and determines the ink level in the ink storage cavity according to the intensity of the second signal received by the second signal receiving element when the ink cartridge is installed into the ink cartridge installation section.

By adoption of the technical proposal, the second signal blocking section is a movable component and is in the initial ink cartridge installation detection position before ink cartridge installation detection, and the initial ink cartridge installation detection position determines whether or not the second signal blocking section prevents the second signal from passing through the second signal blocking section or changes the path of the second signal. That is to say, different ink cartridges can be distinguished by different initial ink cartridge installation detection positions of the movable second signal blocking section and the ink cartridge installation error easily caused by the fact that different ink cartridges are distinguished by different thicknesses of second signal blocking sections does not occur, thus the technical problem, in the traditional ink cartridge, ink cartridge set and ink cartridge determination system, that different ink cartridges are distinguished by different thicknesses of second signal blocking sections, which causes the ink cartridge installation error easily and enables a printer to detect information not matched with the actual information of an ink cartridge, is solved.

BRIEF DESCRIPTION OF THE DRAWINGS

FIGS. 12(*c*) and 12(*d*) are respectively illustrative time sequence charts of sensor signals outputted by the first sensor and the second sensor of the recording device when the ink cartridge 1' is installed into the ink cartridge installation section;

DETAILED DESCRIPTION OF THE PREFERRED EMBODIMENTS

Figure 1:
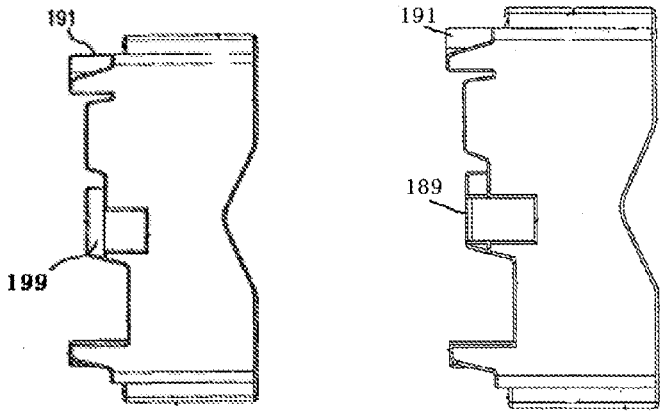
FIG. 1 is a contrast diagram of second signal blocking sections of a first ink cartridge and a second ink cartridge in the traditional ink cartridge set.

As illustrated in FIG. 1, as the thickness of second signal blocking sections (189, 199) of different types of ink cartridges in the traditional ink cartridge set is different, different types of ink cartridges must be installed with the second signal blocking sections (189, 199) with corresponding thickness to form complete ink cartridges during the production and ink cartridge installation. Once the ink cartridge installation error of an ink cartridge occurs, a printer will detect information not matched with the actual information of the ink cartridge.

Therefore, by adoption of the technical proposal, the detection time sequence problem during the ink cartridge installation detection is solved by different initial ink cartridge installation detection positions and same thickness.

The embodiment of the invention and the characteristics and technological merits thereof could be understood by those skilled in the art through FIGS. 1-13, and same labels are used to refer to corresponding same parts in various drawings.

Figure 2:
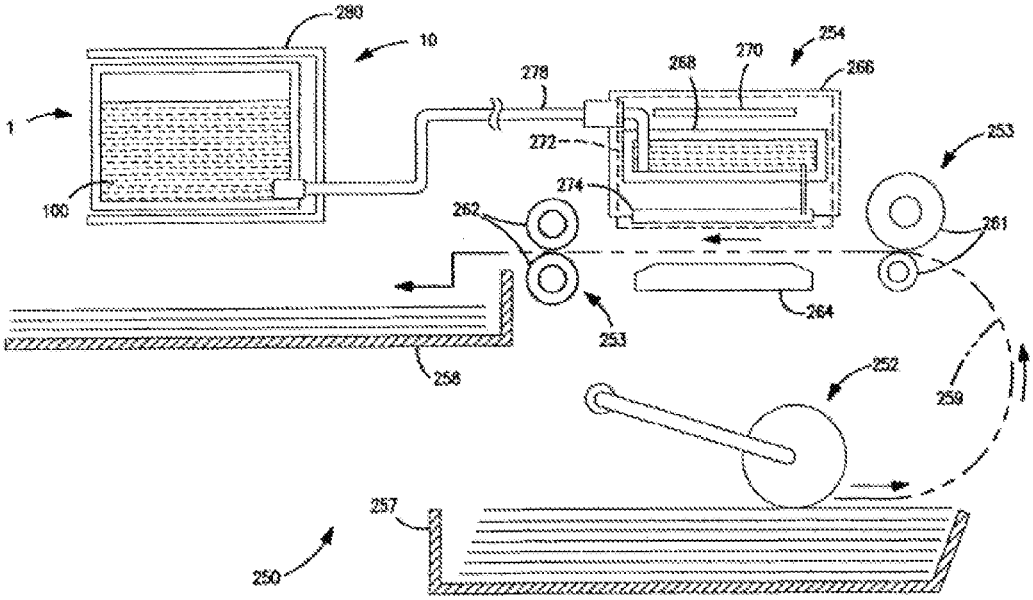
FIG. 2 is a model diagram of a recording device of the embodiment of the invention.

FIG. 2 illustrates a recording device 250 of the embodiment of the invention. The recording device 250 comprises a paper feeding device 252, a conveying device 253, a recording unit 254 and an ink cartridge installation section 10, wherein a paper feeding tray 257 is arranged at the bottom of the recording device 250, and a plurality of paper sheets on the paper feeding tray 257 are fed into a channel 259 one by one through the paper feeding tray 252.

The conveying device 253 is arranged inside the channel 259 and comprises a first pair of conveying rollers 261 and a second pair of conveying rollers 262, wherein the first pair of conveying rollers 261 are arranged on the upstream side of the recording unit 254 and the second pair of conveying rollers 262 are arranged on the downstream side of the recording unit 254 in the paper conveying direction.

The recording unit 254 is arranged on a pressing plate 264, and images are recorded on paper sheets just passing through the upper part of the pressing plate 264 through the recording unit 254.

The recording unit 254 comprises a carriage 266 and a recording head 272 which is arranged on the carriage 266, wherein the recording head 272 comprises a sub-container 268 and a head control panel 270 and is provided with a plurality of nozzles 274 which are arranged inside the recording head 272; the carriage 266 is slideably supported by a support rail; and the sub-container 268 is used for storing ink supplied to the nozzles 274.

The ink cartridge 1 is installed into the ink cartridge installation section 10 which comprises a plurality of casings 280, wherein each casing is configured to receive the corresponding ink cartridge 1. For example, the ink cartridge installation section 10 comprises four casings 280, and each casing 280 corresponds to an ink cartridge containing ink of different color. The ink cartridge 1 comprises an ink storage cavity 100 for storing the ink, and the ink is supplied from the ink storage cavity 100 to the recording head 272 through an ink pipe 278.

Figure 3:
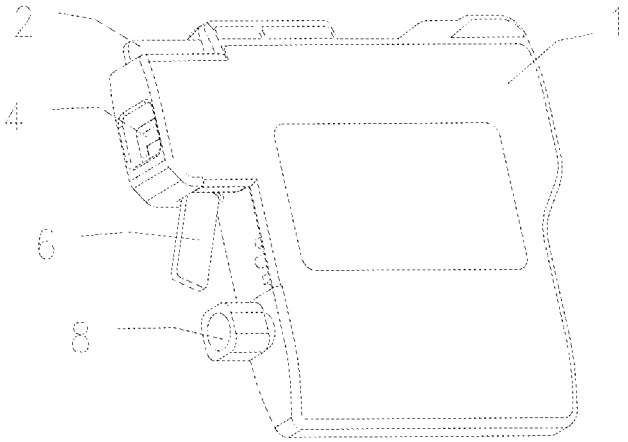
FIG. 3 is a schematic diagram of an ink cartridge of the embodiment of the invention.

As illustrated in FIG. 3, the ink cartridge 1 of the embodiment of the invention comprises the ink storage cavity 100 (as illustrated in FIG. 2), an ink cartridge installation detection mechanism (a first signal blocking section 2 and a movable member 6), an ink level detection mechanism (the movable member 6 and a lever assembly 9, not shown in the figure), an ink outlet 8 and a spring-actuated mechanism (an offsetting component 4).

Wherein, a fixed quantity of ink is stored into the ink storage cavity 100, and at least one outerwall of the ink storage cavity 100 is formed by a deformable membrane. The ink is supplied from the ink storage cavity 100 to a printer through the ink outlet 8.

The ink cartridge installation detection mechanism comprises the first signal blocking section 2 and a second signal blocking section which comprises the movable member 6 and a shaft 7.

During the ink cartridge installation, firstly, a second signal emitted by a second sensor 102 is blocked by a second signal blocking area 61 of the movable member 6 for the first time; secondly, a first signal emitted by a first sensor 104 is blocked by the first signal blocking section 2, which is continued in the whole ink cartridge installation process; thirdly, the movable member rotates around the shaft 7 along the direction opposite to the ink cartridge installation direction under the action of the offsetting component 4 and a tension generating component 5 together, is deviated from the second sensor 102, and does not block the second sensor 102 again; fourthly, the movable member 6 is abutted against by a abutment section 93 and does not continue to move again when rotating around the shaft 7 to the abutment section 93 at one end of the lever assembly 9; and finally, the ink cartridge installation process continues, and the second sensor 102 is blocked by the second signal blocking area 61 of the movable member 6 again, so far the first sensor 104 is blocked by the first signal blocking section 2 and the second sensor 102 is blocked by the movable member 6, and the ink cartridge installation detection process is over. The offsetting component 4 is a spring plate of which one end is fixedly connected with the front wall of a cartridge body and the other end abuts against the wall of a receiving space of the ink cartridge for the printer; a support is arranged on the spring plate; the movable member is supported by the support on the offsetting component; and the support can be a supporting slot and can also be a hook.

The ink level detection mechanism comprises the movable member 6 and a linkage which is the lever assembly 9, wherein the lever assembly 9 comprises a lever 91 and a lever rotating shaft 95; and a abutment section 93 in the shape of an inclined plane is formed at one end of the lever 91, and a flat plate 92 is formed at the other end of the lever 91. Of course, the linkage can also be other transmission components capable of converting the residual ink volume in the ink cartridge into an acting force applied to the movable member, such as a supporting cap which is communicated with the ink storage cavity.

Figure 8:
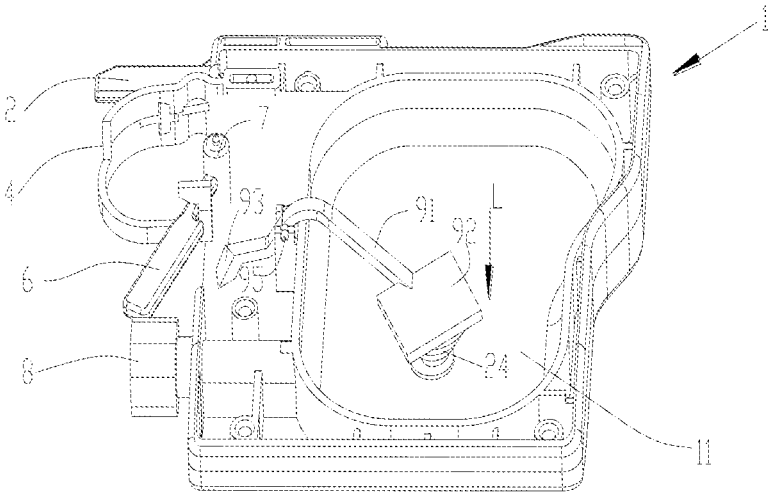
FIG. 8 is a schematic diagram illustrating the movement of a detection component involved during the ink level detection of the ink cartridge of the embodiment of the invention.
Figure 9:
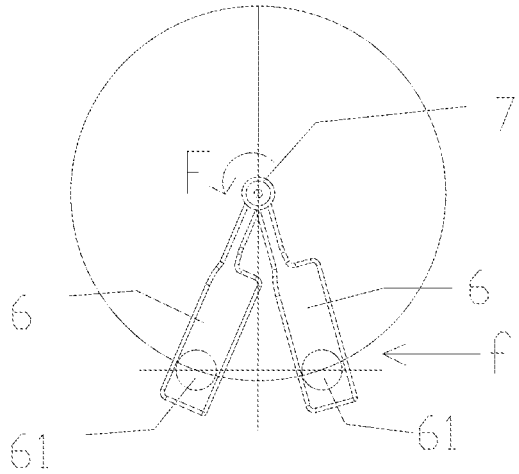
FIG. 9 is a schematic diagram illustrating the ink level detection principle of the ink cartridge of the embodiment of the invention.

During the ink level detection, when a fixed quantity of ink (2-3 ml) is consumed, the deformable membrane wall of the ink storage cavity 100 is greatly deformed; the flat plate 92 of the lever 91 is fixedly connected with the membrane and moves along the L direction (as illustrated in FIG. 8); the lever 91 is connected with the abutment section 93 through the lever rotating shaft 95; the abutment section 93 is deviated from a position at which the abutment section 93 abuts against the movable member 6 and does not abut against the movable member 6 again; and under the action of a force F (as illustrated in FIG. 9) of the tension generating component 5, the movable member 6 is deviated from a position at which the movable member 6 blocks the second sensor 102 and does not block the signal of the second sensor again, so far the printer detects the ink-out condition of the ink cartridge 1.

The ink outlet 8 comprises a sealing component which is engaged with an ink supply needle of the printer for sealing to prevent the ink leakage after the ink cartridge installation and is self-sealed to prevent the ink leakage in the ink storage cavity 11 when the ink cartridge is not installed into the printer.

The spring-actuated mechanism comprises the offsetting component 4 which can eject out the ink cartridge 1 from an ink cartridge bin 10 when the ink cartridge is not clamped by a fixed clamping rod 105, thus the assembly and disassembly of the ink cartridge is convenient.

When the ink cartridge 1 is detached from the ink cartridge bin 10, the movable member 6 can be reset to an initial ink cartridge installation position by the offsetting component 4.

Figure 4:
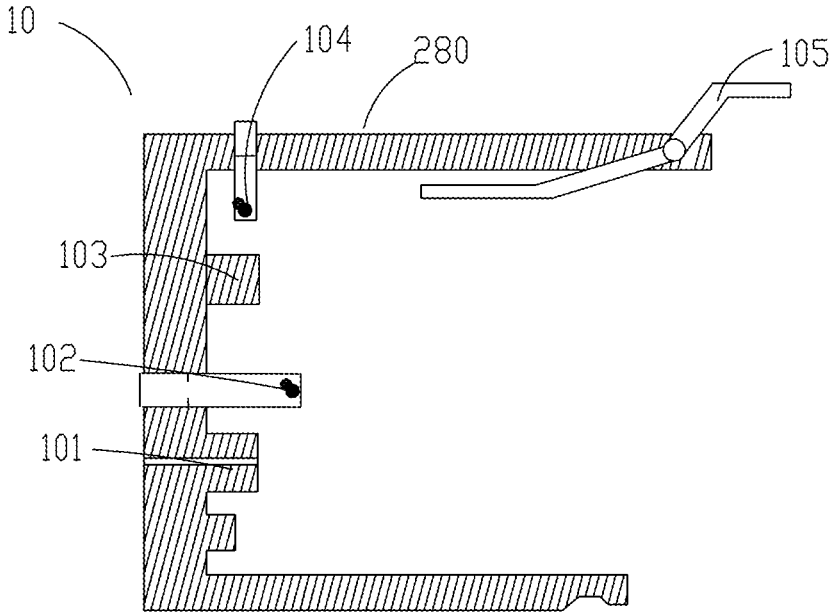
FIG. 4 is a schematic diagram of an ink cartridge installation section of the embodiment of the invention.

As illustrated in FIG. 4, the ink cartridge installation section 10 comprises a plurality of casings 280, and each casing 280 is provided with a printer ink supply opening 101, a second sensor 102, a bulge 103, a first sensor 104 and a fixed clamping rod 105.

Optical sensors on the ink cartridge installation section 10 are the first sensor 104 and the second sensor 102, and the ink cartridge installation detection and the ink level detection are completed under the cooperated detection of the two optical sensors.

The ink supply opening 101 can be engaged with the ink outlet 8 of the ink cartridge to convey ink to a printhead after the ink cartridge 1 is installed.

The second sensor 102 can be engaged with the first sensor 104 to complete the ink cartridge installation detection and the ink level detection in the ink cartridge 1 after the variation of the ink level in the ink cartridge 1.

The bulge 103 can abut against the offsetting component 4 to drive the offsetting component 4 to be in the deformed state, and can be engaged with the offsetting component 4 to eject out the ink cartridge, so that the assembly and disassembly of the ink cartridge is convenient.

The first sensor 104 can be engaged with the second sensor 102 to complete the installation detection of the ink cartridge 1.

The fixed clamping rod 105 can be engaged with the bulge on the upper part of the ink cartridge 1 to fix the ink cartridge 1 inside the ink cartridge bin 10. The fixed clamping rod 105 is arranged on the upper wall of the casing 280 and connected with the casing 280 through a shaft; and a torsion spring is embedded on the shaft which drives the fixed clamping rod 105 to rotate around the shaft through a torsional force and automatically clamps the ink cartridge 1.

Figure 5:
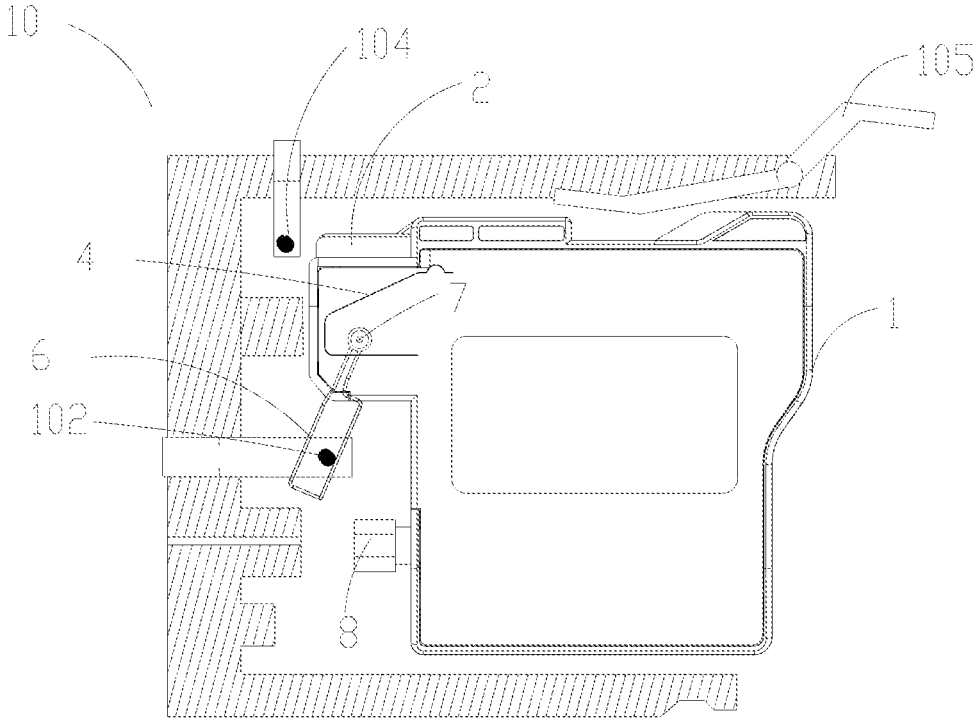
FIG. 5 is a schematic diagram illustrating the installation process of the ink cartridge of the embodiment of the invention.

As illustrated in FIG. 5, during the ink cartridge installation, the second signal emitted by the second sensor 102 is blocked by the second signal blocking area 61 of the movable member 6 for the first time; the first sensor 104 is not blocked by the first signal blocking section 2; and the fixed clamping rod 105 on the ink cartridge bin 10 is deviated from a fixed position when the ink cartridge 1 is installed and reset to the fixed position after the ink cartridge 1 is installed.

Figure 6:
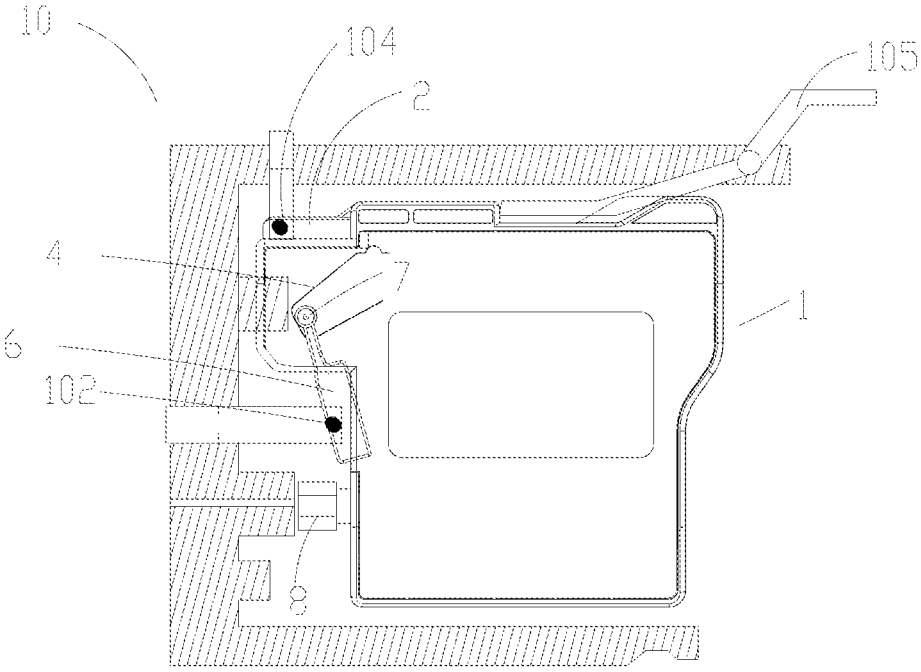
FIG. 6 is a schematic diagram of the ink cartridge of the embodiment of the invention after the ink cartridge is fully installed.

As illustrated in FIG. 6, after the ink cartridge 1 is installed, the first sensor 104 is blocked by the first signal blocking section 2 and the second sensor 102 is blocked by the movable member 6; the bulge 103 on the ink cartridge bin 10 of the printer abuts against the offsetting component 4 of the ink cartridge 1, and the offsetting component 4 is in the deformed state; the fixed clamping rod 105 on the ink cartridge bin 10 is at the fixed position after the ink cartridge 1 is installed; and the printer ink supply opening 101 is in close connection with the ink outlet 8 of the ink cartridge 1.

Figure 7:
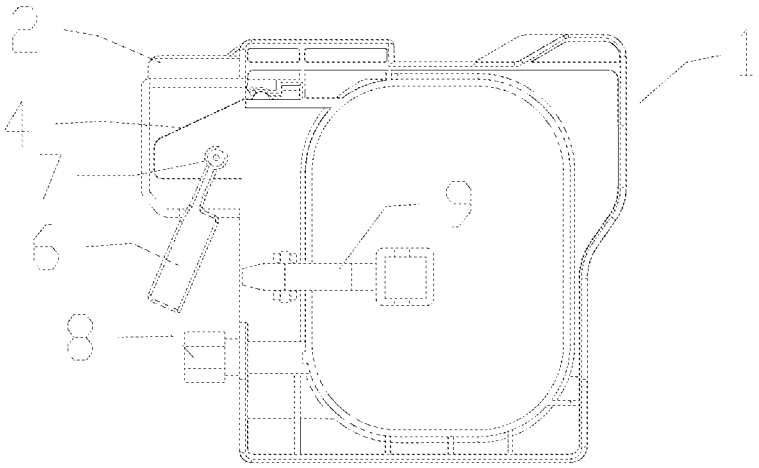
FIG. 7 is a schematic diagram of an ink bag of the invention.

As illustrated in FIG. 7, a mechanism engaged for the ink level detection in the ink cartridge 1 is the lever assembly 9 which can be engaged with the movable member 6 to complete the ink level detection by moving around the shaft with the variation of the membrane wall of the ink storage cavity. As the ink supply opening of the printer has certain suction force, the ink in the ink storage cavity 11 of the ink cartridge 1 can be sucked out. As only the ink outlet 8 of the ink storage cavity 11 is connected with the outside, when the ink level is reduced, the volume of the ink storage cavity 11 is changed and the membrane wall of the ink storage cavity 11 is deformed as well.

As illustrated in FIG. 8, the flat plate 92 at one end of the lever assembly 9 is fixedly connected with the membrane wall of the ink storage cavity 11. The flat plate 92 and the membrane wall can be glued together by double-faced adhesive tape and can also be connected with each other through fixed clamping positions. When the membrane wall is deformed, the flat plate 92 moves along the L direction; the lever 91 is connected with the abutment section 93 through the lever rotating shaft 95; and the abutment section 93 is deviated from the position at which the abutment section 93 abuts against the movable member 6 and does not abut against the movable member 6 again.

The membrane wall of the ink cartridge 1 can be deformed, and the deformed position of the membrane is related to the thickness of the membrane and the pressure born. In order to guarantee that only a connected position of the flat plate 92 and the membrane is deformed when the ink will be out, a spring 24 is arranged at a corresponding position of the flat plate 92 in the ink storage cavity 11 to balance the internal pressure and drive the connected position of the flat plate 92 and the membrane to be deformed finally.

As illustrated in FIG. 9, during the ink cartridge installation detection, the movable member 6 moves around the shaft 7; and in the beginning, the movable member 6 is at the initial ink cartridge installation detection position and the second signal is blocked by the second signal blocking area 61 of the movable member 6. During the ink cartridge installation, the movable member 6 moves under the action of a force F of the tension generating component 5; when the movable member 6 comes into contact with the abutment section 93 of the lever assembly 9, namely an engagement position, an abutment force f and the force F are neutralized to drive the movable member 6 to be at an ink level detection position corresponding to the second sensor of the printer, which is a blocking position after the ink cartridge installation; and when the movable member 6 is at the ink level detection position corresponding to the second sensor of the printer, the second signal is blocked for the second time by the second signal blocking area 61 of the movable member 6, and the ink cartridge installation detection is completed.

Figure 10:
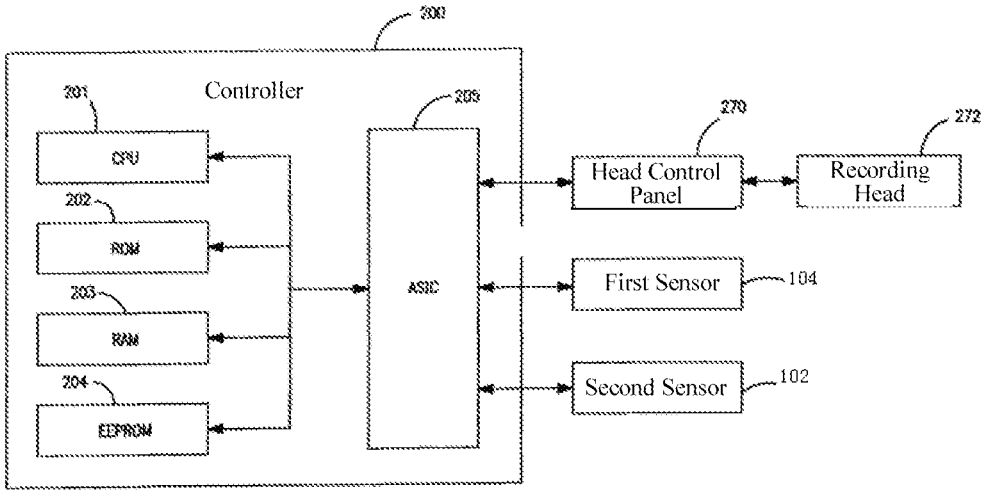
FIG. 10 is a modularized schematic diagram of a master controller for the recording device of the embodiment of the invention.

As illustrated in FIG. 10, the master controller 200 controls the operation of the recording device 250. The master controller 200 is a microcomputer and comprises a Central Processing Unit (CPU) 201, a Read Only Memory (ROM) 202, a Random Access Memory (RAM) 203, an Electrically Erasable Programmable Read Only Memory (EEPROM) 204 and an Application Specific Integrated Circuit (ASIC) 205.

The ROM 202 is used for storing programs used by the CPU 201 to control corresponding operations of the recording device 250 and programs used by the CPU 201 to distinguish the type of the ink cartridge 1 and the ink cartridge 1'. The RAM 203 is used for temporarily storing memory areas or work areas used by the CPU 201 to execute the programs. The EEPROM 204 is used for storing set values, flags, etc. to be reserved even after power off.

As illustrated in FIGS. 2 and 10, the head control panel 270, the first sensor 104 and the second sensor 102 are connected to the ASIC 205. Moreover, a drive circuit (not shown) for driving corresponding rollers of the paper feeding device 252 and the conveying device 253, an input unit for inputting a print order into the recording device 250, and a display device for displaying information related to the recording device 250 are also connected to the ASIC 205.

The head control panel 270 controls the recording head 272 according to a signal supplied by the ASIC 205, such as an image signal for a control signal, and ink is selectively drained off at scheduled time from the nozzles 274 of the recording head 272.

The second sensor 102 outputs the sensor signal according to the intensity of light received by a light receiving element. For example, an analog electrical signal such as a voltage signal or a current signal is outputted from the second sensor 102 according to the intensity of the light received by the light receiving element. The sensor signal outputted by the second sensor 102 is supplied to the master controller 200 which determines the sensor signal to be a high-level signal when the level of the sensor electrical signal, such as the voltage value or the current value, is more than or equal to the predefined threshold, and determines the sensor signal to be a low-level signal when the level is less than the threshold. For example, the master controller 200 determines the sensor signal to be a low-level signal when an optical path of the second sensor 102 is blocked and determines the sensor signal to be a high-level signal when the optical path is not blocked. When light transmitted by a light transmitting element is blocked or the optical path is changed, the intensity of the light received by the light receiving element can be zero.

The first sensor 104 basically adopts the same way with the second sensor 102, and outputs the sensor signal according to the intensity of the light received by the light receiving element.

Figure 11:
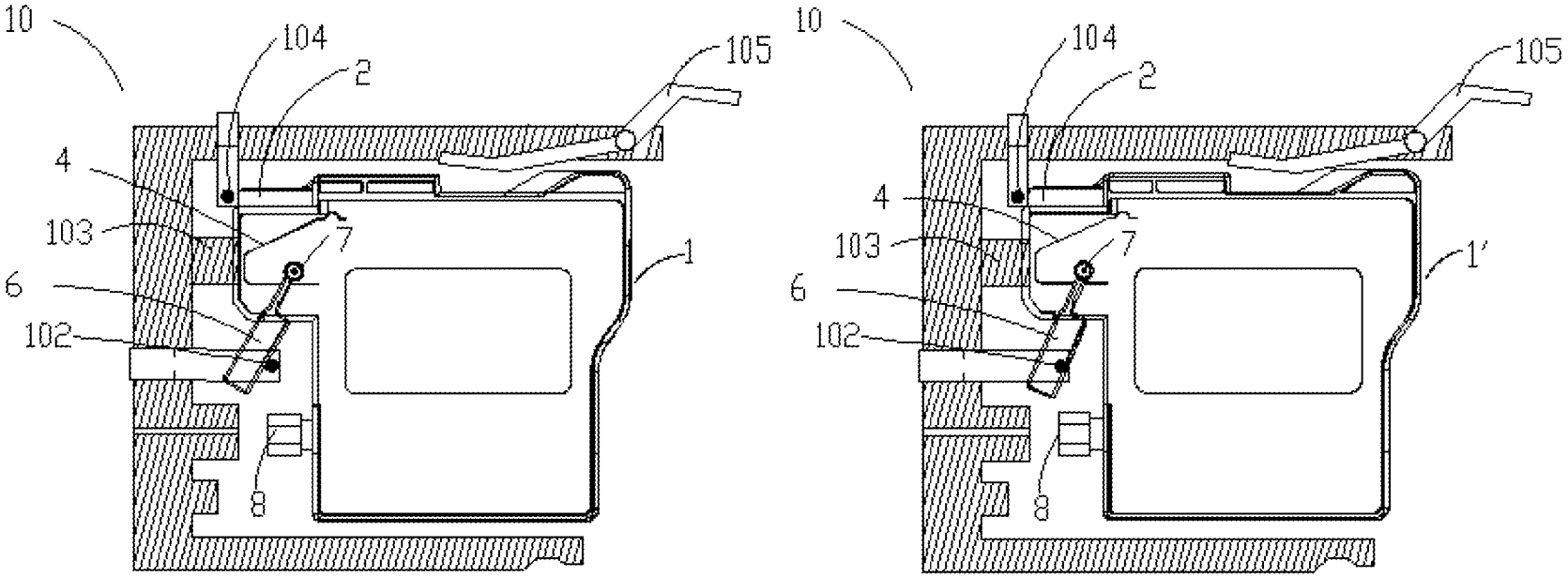
FIG. 11 is schematic diagrams of an ink cartridge 1 and an ink cartridge 1' of the embodiment of the invention when installed at the moment T1.

As illustrated in FIG. 11, when the ink cartridge 1 and the ink cartridge 1' with different types or ink levels in the ink cartridge set are installed into the ink cartridge installation section 10, the initial ink cartridge installation detection position of the second signal blocking section of the ink cartridge 1 is different from that of the second signal blocking section of the ink cartridge 1', namely the distance between the initial ink cartridge installation detection position of the second signal blocking section of the ink cartridge 1 and the ink level detection position of the ink cartridge 1 is different from the distance between the initial ink cartridge installation detection position of the second signal blocking section of the ink cartridge 1' and the ink level detection position of the ink cartridge 1'. The printer can distinguish the ink cartridge 1 and the ink cartridge 1' according to different time sequences of sensor signals detected.

When the ink cartridge 1 is installed into the ink cartridge installation section 10, the ink cartridge 1 is horizontally installed into the ink cartridge installation section 10 and the fixed clamping rod 105 is pushed away from the fixed position. When the ink cartridge installation process continues, firstly, the movable member 6 of the second signal blocking section of the ink cartridge 1 is detected when being in the initial ink cartridge installation detection position and prevents the second signal to pass through; secondly, a detection component of the second sensor 102 passes through the second signal blocking section, and the optical path of the second sensor 102 is communicated; and thirdly, the first sensor 104 is blocked by the first signal blocking section 104, which is continues until the ink cartridge installation process is over. Moreover, the ink cartridge 1 is installed into the ink cartridge installation section 10 continuously; the offsetting component 4 is driven to be deformed as the offsetting component 4 abuts against the bulge 103; the support on the offsetting component 4 does not support the movable member 6 again; the movable member 6 moves under the action of the force F (as illustrated in FIG. 9); after the optical path of the second sensor 102 is communicated for a certain period of time, the movable member 6 of the second signal blocking section blocks the second signal again; and simultaneously, a concave portion on the upper wall of the ink cartridge 1 is engaged with the fixed clamping rod 105 to fix the ink cartridge 1, so far the ink cartridge installation process is over.

When the ink cartridge 1' is installed into the ink cartridge installation section 10, the ink cartridge 1' is horizontally installed into the ink cartridge installation section 10 and the fixed clamping rod 105 is pushed away from the fixed position. When the ink cartridge installation process continues, firstly, the movable member 6 of the second signal blocking section of the ink cartridge 1' is detected when being in the initial ink cartridge installation detection position and prevents the second signal to pass through; secondly, the detection component of the second sensor 102 is blocked by the second signal blocking section all the while; and thirdly, when the optical path of the second sensor 102 is not communicated, the first sensor 104 is blocked by the first signal blocking section 104, which is continues until the ink cartridge installation process is over. Moreover, the ink cartridge 1' is installed into the ink cartridge installation section 10 continuously; the offsetting component 4 is driven to be deformed as the offsetting component 4 abuts against the bulge 103; the support on the offsetting component 4 does not support the movable member 6 again; the movable member 6 moves under the action of the force F (as illustrated in FIG. 9); after the optical path of the second sensor 102 is communicated for a certain period of time, the movable member 6 of the second signal blocking section blocks the second signal again; and simultaneously, a concave portion on the upper wall of the ink cartridge 1' is engaged with the fixed clamping rod 105 to fix the ink cartridge 1', so far the ink cartridge installation process is over.

Figure 12:
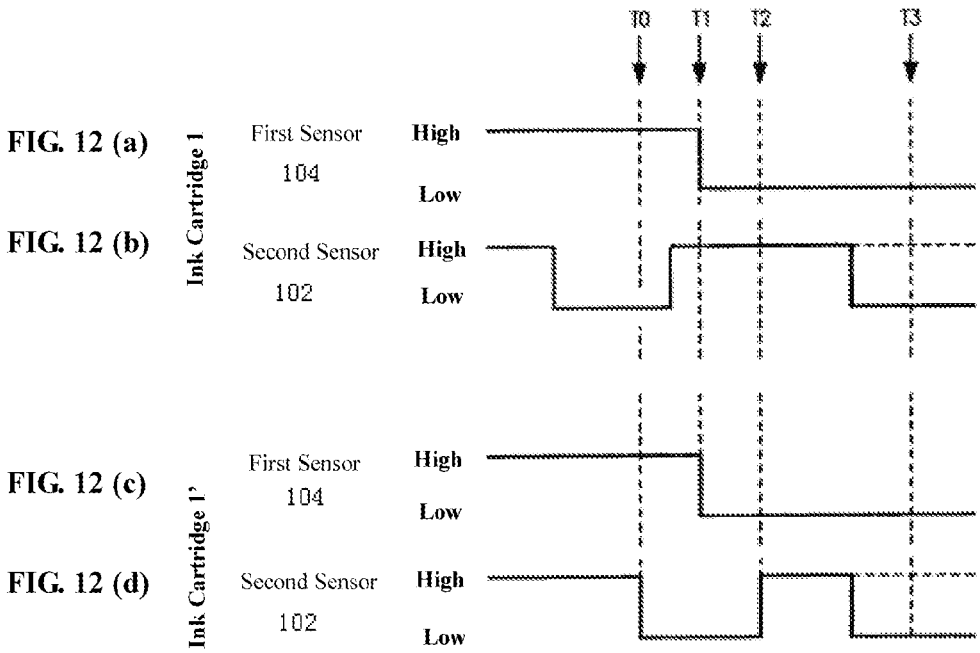
FIGS. 12(*a*) and 12(*b*) are respectively illustrative time sequence charts of sensor signals outputted by a first sensor and a second sensor of the recording device when the ink cartridge 1 is installed into the ink cartridge installation section.

FIGS. 12(*a*) and 12(*b*) are respectively illustrative time curves of the signal level of the sensor signals outputted from the first sensor 104 and the second sensor 102 when the ink cartridge 1 is installed.

FIGS. 12(*c*) and 12(*d*) are respectively illustrative time curves of the signal level of the sensor signals outputted from the first sensor 104 and the second sensor 102 when the ink cartridge 1' is installed.

As illustrated in FIGS. 12(*a*) and 12(*c*), the time curve of the signal level of the sensor signal outputted from the first sensor 104 when the ink cartridge 1 is installed into the casing 280 is the same with that of the signal level of the sensor signal outputted from the first sensor 104 when the ink cartridge 1' is installed into the casing 280. More specifically, the signal level is changed from high to low at the moment T1 when the first signal blocking section 2 enters into the optical path of the first sensor 104 and blocks the light or changes the optical path. The change of the signal level from high to low in the master controller 200 corresponds to the detection of a trigger signal during the determination of the type of the ink cartridge.

As illustrated in FIG. 12(*b*), when the ink cartridge 1 is installed into the casing 280, the second signal blocking section has entered into the optical path to block the light or change the optical path before the moment T0. Herein, the change of the signal level of the sensor signal outputted from the second sensor 102 has continued for a period of time. As the blocking area of the movable member 6 of the second signal blocking section is fixed and has begun to block the second signal or change the path of the second signal before the moment T0, the signal level of the second sensor 102 has been restored from low to high at the moment T1.

Subsequently, when the ink cartridge 1 is further inserted into the casing 280, the movable member 6 of the second signal blocking section passes through a detection area of the second sensor 102 which is in the optical path communication state, and the signal level continues to be high; the offsetting component 4 does not support the movable member 6 of the second signal blocking section again; and the movable member 6 moves at the moments T2 and T3 and enters into the optical path of the second sensor 102 to block the signal of the second sensor 102 again. As illustrated in FIG. 12(*b*), the signal level when the second signal blocking section is in the optical path of the second sensor 102 is indicated by the solid line (low level), and the signal level when the second signal blocking section is away from the optical path of the second sensor 102 is indicated by the dashed line (high level).

As illustrated in FIG. 12(*d*), when the ink cartridge 1' is installed into the casing 280, the second signal blocking section enters into the optical path at the moment T0 to block the light or change the optical path. Herein, the signal level of the sensor signals outputted from the second sensor 102 is changed from high to low. As the blocking area of the movable member 6 of the second signal blocking section is fixed and begins to block the second signal or change the path of the second signal at the moment T0, the signal level of the second sensor 102 is maintained to be low at the moment T1.

Subsequently, when the ink cartridge 1' is further inserted into the casing 280, the movable member 6 of the second signal blocking section passes through the detection area of the second sensor 102 which is in the optical path communication state, and the signal level continues to be high; the offsetting component 4 does not support the movable member 6 of the second signal blocking section again; and the movable member 6 moves at the moments T2 and T3 and enters into the optical paths of the second sensor 102 to block the signal of the second sensor 102 again. As illustrated in FIG. 12(*d*), the signal level when the second signal blocking section is in the optical path of the second sensor 102 is indicated by the solid line (low level), and the signal level when the second signal blocking section is away from the optical path of the second sensor 102 is indicated by the dashed line (high level).

The type of the ink cartridge is determined by the master controller 200 according to the time curves of the first sensor 104 and the second sensor 102.

Figure 13:
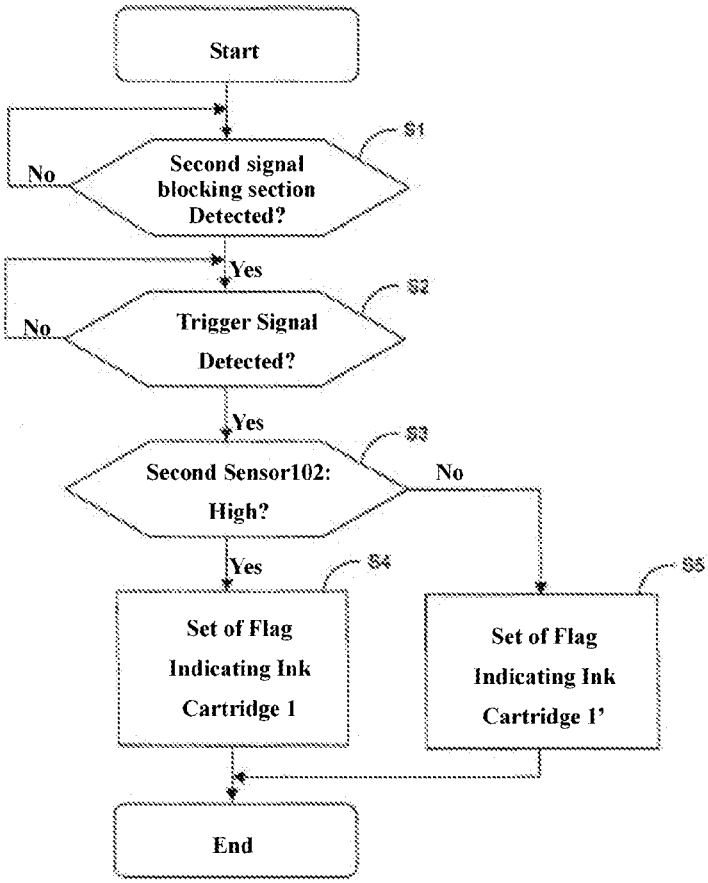
FIG. 13 is a flowchart of programs executed by the master controller of the recording device of the embodiment of the invention.

FIG. 13 illustrates the process of determining whether the ink cartridge installed is the ink cartridge 1 or the ink cartridge F. In step S1, the master controller 200 determines whether or not the second signal blocking section has blocked the second signal or changed the optical path of the second sensor 102.

For example, the master controller 200 determines whether or not the signal level of the sensor signal outputted from the second sensor 102 has been changed from high to low. When the master controller 200 determines that the second signal blocking section has blocked the second signal or changed the optical path of the second sensor 102, the step S2 is carried out. That is to say, the step S2 is only carried out until the master controller 200 determines that the signal level of the second sensor 102 is low.

In the step S2, the master controller 200 determines whether or not the first signal blocking section 2 has blocked the first signal or changed the path of the first signal. For example, the master controller 200 determines whether or not the signal level of the first sensor 104 has been changed from high to low, which corresponds to the detection of the trigger signal. When the trigger signal is detected in the step S2, the master controller 200 determines whether the signal level of the sensor signal outputted from the second sensor is high or low at the moment T1 for the detection of the trigger signal in step S3. For example, when the signal level at the moment T1 is high, the master controller 200 determines that the ink cartridge 1 is inserted into the casing 208; and when the signal level at the moment T1 is low, the master controller 200 determines that the ink cartridge 1' is inserted into the casing 208.

On one hand, when the signal level of the sensor signal outputted from the second sensor 102 is determined to be high in the step S3, a position flag indicating the installed ink cartridge corresponding to the ink cartridge 1 is set on a register such as a register for the CPU 201 in step S4. If a position flag indicating the installed ink cartridge corresponding to the ink cartridge 1' has been preset, the position flag indicating the installed ink cartridge corresponding to the ink cartridge 1' is cleared and the position flag of the installed ink cartridge corresponding to the ink cartridge 1 is set. On the other hand, when the signal level of the sensor signal outputted from the second sensor 102 is low, the position flag indicating the installed ink cartridge corresponding to the ink cartridge 1' is set on the register in step S5. If the position flag indicating the installed ink cartridge corresponding to the ink cartridge 1 has been preset, the position flag indicating the installed ink cartridge corresponding to the ink cartridge 1 is cleared and the position flag indicating the installed ink cartridge corresponding to the ink cartridge 1' is set. If the position flag is set, the recording device 250 or an information processing unit for a personal computer, which is connected with the recording device 250, indicates whether the ink cartridge 1 or the ink cartridge 1' is inserted according to the flag.

If the signal level of the first sensor 104 is changed from low to high, the determination process can be repeated again. Moreover, the determination process can be carried out when the fixed clamping rod 105 is opened and can be over when the fixed clamping rod 105 is closed.

The type of the ink cartridge 1 and the ink cartridge 1' is determined at the moment T1 for the detection of the trigger signal according to the signal level of the sensor signal outputted from the second sensor 102. The identification technology can be based on the position change of ink cartridges with second signal detection components with same thickness. Therefore, the ink cartridge installation error of different types of ink cartridges and second signal blocking sections with corresponding thickness during the production and ink cartridge installation due to the different thicknesses of the second signal blocking sections of various ink cartridges of the traditional ink cartridge set can be avoided.

Figure 14:
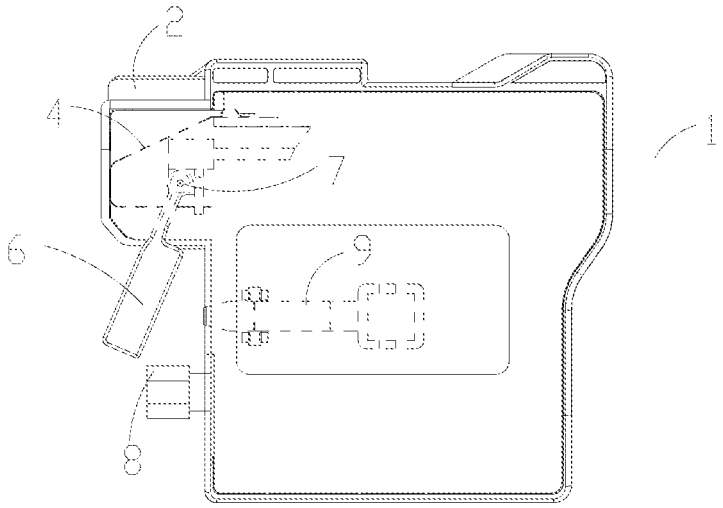
FIG. 14 is a schematic diagram of an ink cartridge before ink cartridge installation, wherein a second signal blocking section of the ink cartridge adopts the mode of horizontal translation.
Figure 15:
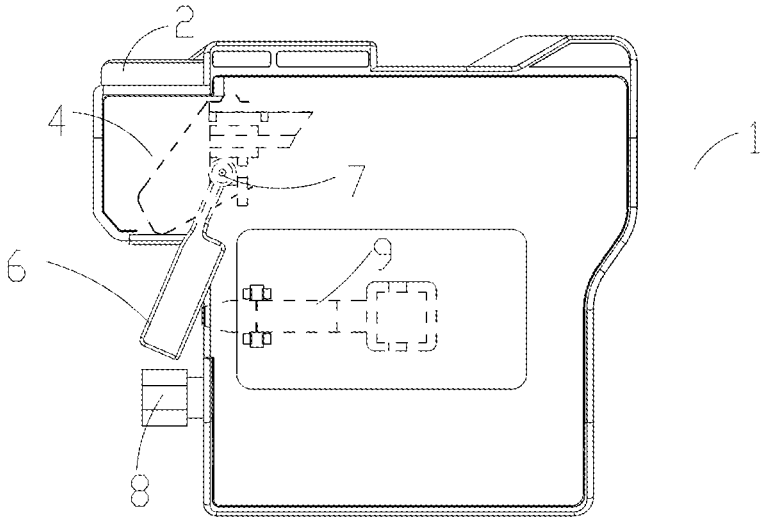
FIG. 15 is a schematic diagram of the ink cartridge after installation, wherein the second signal blocking section of the ink cartridge adopts the mode of horizontal translation.

As illustrated in FIGS. 14 and 15, the second signal blocking section can also realize the selective blocking by means of horizontal translation, and the shaft 7 on the ink cartridge 1 is arranged on a moving part. When the ink cartridge 1 is installed, the offsetting component 4 abuts against the bulge 103 on the ink cartridge installation section 10 to be deformed; the moving part is connected with the offsetting component 4 and moves along the horizontal direction; and a support is arranged on the offsetting component 4 to support the movable member 6 and connected with the shaft 7 through the moving part. Due to the horizontal movement of the moving part, the second signal blocking section is subjected to horizontal movement together and engaged with the first signal blocking section 2 to complete the ink cartridge installation detection.

With the movement of the offsetting component 4, the shaft 7, together with the movable member 6, moves horizontally to another position, namely a position at which the movable member 6 abuts against the lever assembly 9, and the shaft 7 and the movable member 6 stop moving.

Herein, the signal of the first sensor is blocked by the first signal blocking section 2 while the signal of the second sensor is blocked by the second signal blocking section, and the ink cartridge installation detection is completed.

What is claimed is:

1. An ink cartridge, comprising:

a first signal blocking section selectively preventing a first signal from passing through said first signal blocking section or changing the path of said first signal; and a second signal blocking section selectively preventing a second signal from passing through said second signal blocking section or changing the path of said second signal, wherein said second signal blocking section is a movable component and is in an initial ink cartridge installation detection position before detection, and said initial ink cartridge installation detection position determines whether or not said second signal blocking section prevents said second signal from passing through said second signal blocking section or changes the path of said second signal, wherein said ink cartridge also comprises an ink storage cavity for storing ink, wherein said second signal blocking section can move to an ink level detection position corresponding to a second sensor in a printer wherein a linkage detects the ink level, and the second signal blocking section is moved by the linkage, wherein said movement refers to horizontal translation or swinging movement around a shaft, and when said second signal blocking section moves to said ink level detection position, said second signal blocking section selectively prevents said second signal from passing through said second signal blocking section or changes the path of said second signal again, wherein said ink storage cavity is in the form of an ink bag, and the volume of a cavity body is varied with the ink level.

2. The ink cartridge according to claim 1, wherein the initial ink cartridge installation detection position of said second signal blocking section is at least matched with at least one related characteristic of said ink cartridge.

3. The ink cartridge according to claim 1, wherein said second signal blocking section can move to an engagement position; and when said second signal blocking section moves to said engagement position, said linkage moves according to the varied ink level in said ink storage cavity so as to selectively abut against said second signal blocking section.

4. An ink cartridge set, comprising a first ink cartridge and a second ink cartridge, wherein said first ink cartridge and said second ink cartridge are ink cartridges according to claim 1;

a second signal blocking section of said first ink cartridge is at an initial ink cartridge installation detection position before insertion for determining that said second signal blocking section prevents said second signal from passing through said second signal blocking section or changes the path of said second signal when a first signal blocking section begins to prevent a first signal from passing through said first signal blocking section or change the path of said first signal; and a second signal blocking section of said second ink cartridge is at an initial ink cartridge installation detection position before insertion for determining that said second signal blocking section does not prevent said second signal from passing through said second signal blocking section or change the path of said second signal when a first signal blocking section begins to prevent a first signal from passing through said first signal blocking section or change the path of said first signal.

5. An ink cartridge determination system, comprising:

an ink cartridge according to any one of claim 1, 2 or 3 or an ink cartridge set according to claim 4;

a recording device, wherein said recording device comprises an ink cartridge installation section on which said ink cartridge is installed;

a first sensor, wherein said first sensor is arranged inside said ink cartridge installation section and comprises a first signal transmitting element for transmitting a first signal and a first receiving element for receiving said first signal;

said first signal blocking section at least selectively prevents said first signal from passing through said first signal blocking section or changes the path of said first signal when said ink cartridge is installed into said ink cartridge installation section; and the intensity of said first signal received by said first signal receiving element when said first signal blocking section prevents said first signal from passing through said first signal blocking section or changes the path of said first signal is different from that of said first signal received by said first signal receiving element when said first signal blocking section does not prevent said first signal from passing through said first signal blocking section or change the path of said first signal;

said second sensor, wherein said second sensor is arranged inside said ink cartridge installation section and comprises a second signal transmitting element for transmitting said second signal and a second receiving element for receiving said second signal;

said second signal blocking section selectively prevents said second signal from passing through said second signal blocking section or changes the path of said second signal when said ink cartridge is installed into said ink cartridge installation section; and the intensity of said second signal received by said second signal receiving element when said second signal blocking section prevents said second signal from passing through said second signal blocking section or changes the path of said second signal is different from that of said second signal received by said second signal receiving element when said second signal blocking section does not prevent said second signal from passing through said second signal blocking section or change the path of said second signal; and a determiner, wherein said determiner determines related information of said ink cartridge according to the intensity of said second signal received by said second signal receiving element when the intensity of said first signal received by said first signal receiving element begins to change when said ink cartridge is installed into said ink cartridge installation section.

6. An ink cartridge set, comprising a first ink cartridge and a second ink cartridge, wherein said first ink cartridge and said second ink cartridge are ink cartridges according to claim 1;

a second signal blocking section of said first ink cartridge is at an initial ink cartridge installation detection position before insertion for determining that said second signal blocking section prevents said second signal from passing through said second signal blocking section or changes the path of said second signal when a first signal blocking section begins to prevent a first signal from passing through said first signal blocking section or change the path of said first signal; and a second signal blocking section of said second ink cartridge is at an initial ink cartridge installation detection position before insertion for determining that said second signal blocking section does not prevent said second signal from passing through said second signal blocking section or change the path of said second signal when a first signal blocking section begins to prevent a first signal from passing through said first signal blocking section or change the path of said first signal.

7. An ink cartridge determination system, comprising:

an ink cartridge according to claim 1 or an ink cartridge set according to claim 6;

a recording device, wherein said recording device comprises an ink cartridge installation section on which said ink cartridge is installed;

a first sensor, wherein said first sensor is arranged inside said ink cartridge installation section and comprises a first signal transmitting element for transmitting a first signal and a first receiving element for receiving said first signal;

said first signal blocking section at least selectively prevents said first signal from passing through said first signal blocking section or changes the path of said first signal when said ink cartridge is installed into said ink cartridge installation section; and the intensity of said first signal received by said first signal receiving element when said first signal blocking section prevents said first signal from passing through said first signal blocking section or changes the path of said first signal is different from that of said first signal received by said first signal receiving element when said first signal blocking section does not prevent said first signal from passing through said first signal blocking section or change the path of said first signal;

said second sensor, wherein said second sensor is arranged inside said ink cartridge installation section and comprises a second signal transmitting element for transmitting said second signal and a second receiving element for receiving said second signal;

said second signal blocking section selectively prevents said second signal from passing through said second signal blocking section or changes the path of said second signal when said ink cartridge is installed into said ink cartridge installation section;

when said ink cartridge is installed into said ink cartridge installation section and said second signal blocking section moves to said ink level detection position, said second signal blocking section selectively prevents said second signal from passing through said second signal blocking section or changes the path of said second signal again; and the intensity of said second signal received by said second signal receiving element when said second signal blocking section prevents said second signal from passing through said second signal blocking section or changes the path of said second signal is different from that of said second signal received by said second signal receiving element when said second signal blocking section does not prevent said second signal from passing through said second signal blocking section or change the path of said second signal; and a determiner, wherein said determiner determines related information of said ink cartridge according to the intensity of said second signal received by said second signal receiving element when the intensity of said first signal received by said first signal receiving element begins to change when said ink cartridge is installed into said ink cartridge installation section and determines the ink level in said ink storage cavity according to the intensity of said second signal received by said second signal receiving element when said ink cartridge is installed into said ink cartridge installation section.

* * * * *